United States Patent [19]

Sorrells, Jr.

[11] 4,271,651

[45] Jun. 9, 1981

[54] BATTEN AND PANELING SYSTEM

[75] Inventor: Paul J. Sorrells, Jr., Tucker, Ga.

[73] Assignee: MM Systems Corporation, Tucker, Ga.

[21] Appl. No.: 44,773

[22] Filed: Jun. 1, 1979

[51] Int. Cl.[3] ..... E04D 1/36

[52] U.S. Cl. ..... 52/460; 52/463; 52/467

[58] Field of Search ..... 52/463, 464, 467, 460, 52/718

[56] References Cited

U.S. PATENT DOCUMENTS

| | | | |
|---|---|---|---|
| 1,648,940 | 11/1927 | Flanagan et al. | 52/520 X |
| 2,358,733 | 9/1944 | Overly | 52/461 |
| 2,976,970 | 3/1961 | Toney | 52/463 X |
| 2,981,387 | 4/1961 | Dutchik | 52/718 |
| 3,055,147 | 9/1962 | Goodwin | 52/463 X |
| 3,975,880 | 8/1976 | Fischer, Jr. | 52/464 |

*Primary Examiner*—Alfred C. Perham
*Attorney, Agent, or Firm*—John B. Armentrout

[57] ABSTRACT

Panel and batten systems are disclosed wherein a plurality of battens are provided in the system, each batten having brackets supporting a gutter in the batten, and the system is further characterized by having the brackets relatively movably guidedly connected in the batten with substructure, and by having a batten cover connected with the brackets in the batten for bodily expanding and contracting longitudinally while supported by the brackets in the batten and covering the gutter and ends of panels in the system which form sides of the batten.

13 Claims, 7 Drawing Figures

Fig. 3
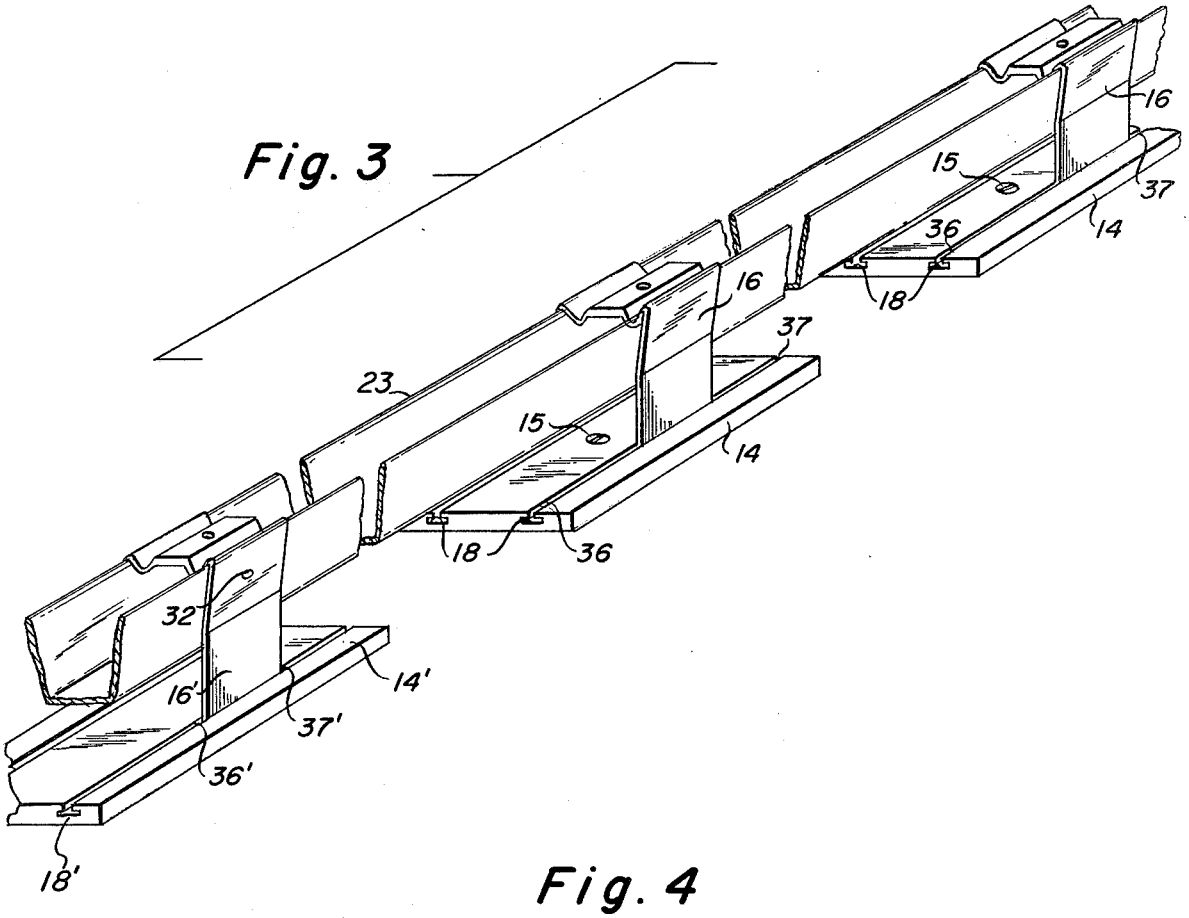
Fig. 4
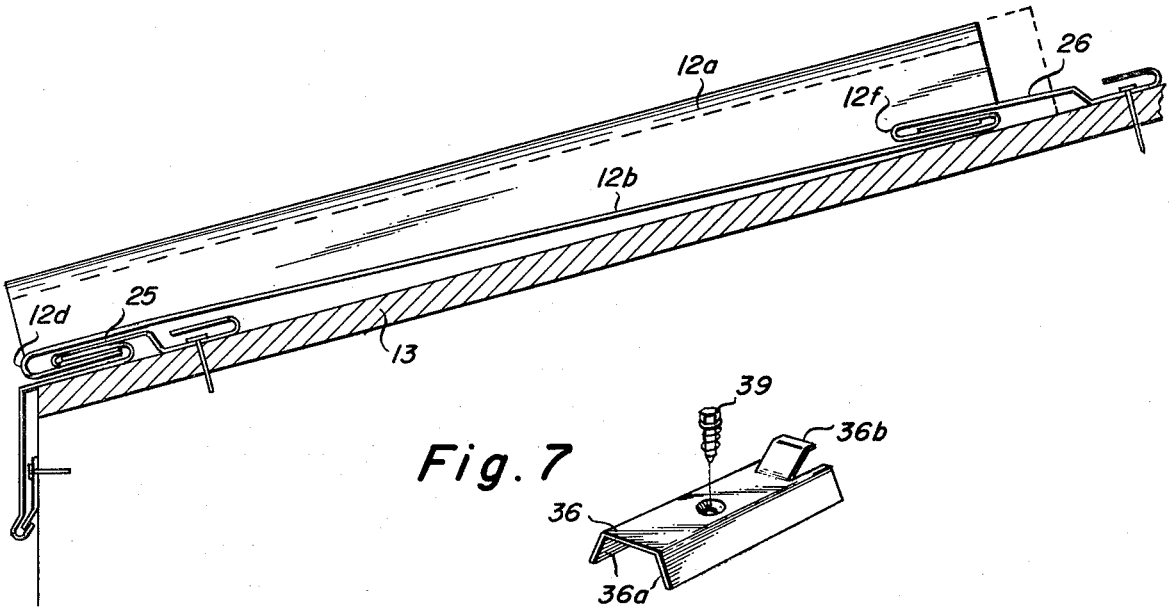
Fig. 7

BATTEN AND PANELING SYSTEM

The present invention relates to panel and batten systems and is more particularly concerned with batten and paneling structure wherein gutters are members of the battens.

An object of the present invention is the provision of practical and commercially feasible panel and batten systems which are characterized by appreciable immunity from stress effects of dimensional changes resulting from thermal changes after the panel and batten system has been installed.

Another object of this invention is to interrelate gutters with the remainder of a panel and batten system, accordingly having the gutters supported in the battens so as to very well tolerate thermal expansion and contraction of the system and meanwhile have the gutters be available to receive and carry off water from the paneling.

A further object herein is to achieve interconnections between substructure and a panel and batten system covering the substructure, whereby expansion and contraction of the battens and the panels prompted by thermal changes can occur with appreciable avoidance of stresses in the panels and in the battens.

Another object of this invention is to provide batten and paneling systems of the character indicated, wherein batten cover members are carried by means arresting the development of stresses in the cover members due to dimensional changes in the batten and paneling system brought about by thermal changes after the system has been installed.

Other objects herein in part will be obvious and in part pointed out more fully hereinafter.

Modern day practice in construction has brought forth batten and panel structures, as for example in the building field, wherein gutters are built into the battens which occur between panel faces, such as in roofing, or siding, or both, the gutter feature for the most part being more popular in batten and panel roofing so as to provide gutters preferably leading longitudinally down the rake of the roof in the system for receiving and shedding incidental amounts of water from the roof panels and thereby protecting the roof substructure against developing leaks. Some of the heretofore known batten and panel systems with gutter facility, however, have fallen short of being well accepted in the competitive market, cost of production illustratively being an adverse factor, or the system structurally sometimes being unable to meet practical requirements in the field. In certain of the heretofore known gutter type batten and panel systems, thermal expansion and contraction have been causes for disappointments in view of the situation that the components used and interrelated in the system failed to share properly for alleviating problems with stress in the system adequately upon encountering thermal changes after being installed.

A further object of the present invention accordingly is to lend improvements in gutter type batten and panel structures and to achieve through these improvements a commercially competitive and practical system furthermore characterized by satisfactory avoidance of stress development from contraction and expansion of components in the system upon the occurrence of thermal changes after the system has been installed.

In accordance with the practice of the present invention, panel and batten systems are provided wherein a plurality of brackets spaced apart from one another in the system are in alignment on an axis. The brackets are movably guidedly connected with substructure, such as in the roof or wall of a building, for the brackets to be moved along the aforementioned axis relatively to the substructure and relatively to one another. Batten cover means extending longitudinally parallel to the axis of alignment of the brackets is secured to the brackets and yet bodily is substantially free to move longitudinally guidedly with the brackets in response to longitudinal contraction and expansion of the batten cover means, thus preventing the development of excessive internal stress in the batten cover means. Gutter means in the system, and also extending longitudinally parallel with the axis of alignment of the brackets, has a laterally open side and is carried on the brackets to expand and contract bodily longitudinally without thus developing excessive longitudinal internal stresses. First and second panel means, each being bodily substantially freely longitudinally expansible and contractable, in the system, also each have batten wall means, raised from panel structure covering areas of the substructure behind the related panel means, and the brackets and gutter means are disposed intermediately of the batten wall means of the first and second panel means. Ends of the batten wall means of the first and second panel means lead into the laterally open side of the gutter means for shedding water into the gutter means and are covered by the batten cover means along with the laterally open side of the gutter means to provide a batten structure and for relative movement to occur between the ends of the batten wall means of the first and second panel means during longitudinal expansion and contraction of the batten cover means. Other such batten structures with brackets, gutter means and batten cover means are provided in the system through using batten wall means additionally afforded by the first and second panel means at opposite lateral ends thereof from the batten wall means aforementioned, and with the addition of third and fourth panel means to share batten wall means with the additional batten wall means provided by the first and second panel means.

A portion of any one or more of the batten cover means, gutter means and panel means may be suitably anchored in the system, thus contributing in that way for the batten cover means, gutter means or the panel means correspondingly longitudinally bodily to expand and contract substantially freely relatively to the anchored portion thereof.

In the accompanying drawings, representing several embodiments of this invention which are presently preferred:

FIG. 3 is a fragmentary isometric view of gutter, brackets and mountings for part of the longitudinal extent of one of the battens represented in FIG. 1;

FIG. 4 is a longitudinal sectional detail view of one of the panel members used in the panel and batten system of FIG. 1 and includes a showing of substructure of the roof;

Figure 6:
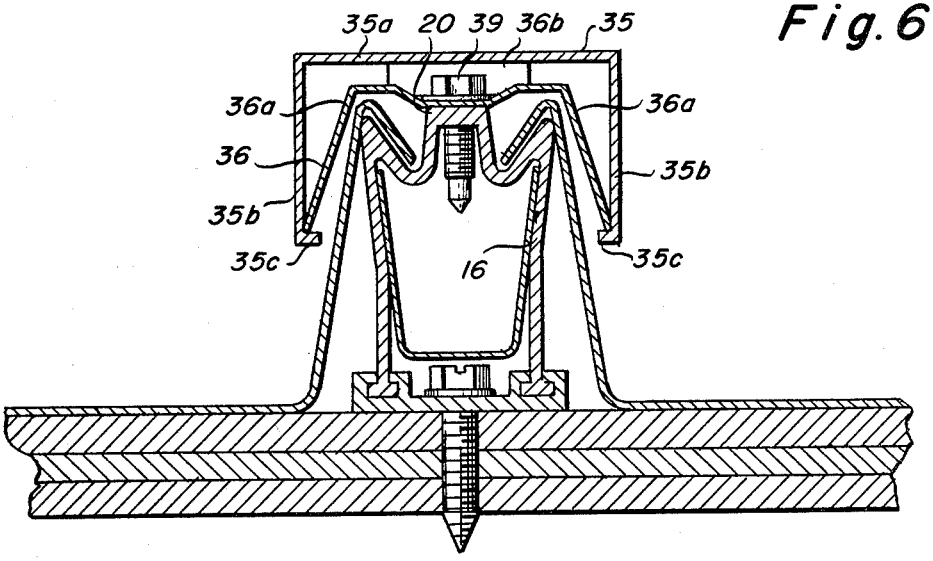

FIG. 6 relates to a modified panel and batten system and more particularly is directed to a batten cover modification; and FIG. 7 corresponds to FIG. 6 and represents clip structure used in securing the batten cover to the brackets.

Referring now more particularly to the accompanying drawings and to the embodiment of the present invention according to FIGS. 1 to 5, inclusive, a panel and batten system 10 comprises a plurality of battens 11 and panel members 12 extending laterally and longitudinally between the battens for the panel and batten system 10 to cover substructure 13 of a building roof. The battens 11 are on parallel axes, and the intermediate panel members 12 longitudinally extend with the battens 11 down the slope of the roof. Each of the battens 11 is comprised of a plurality of brackets 16 (see FIG. 3) aligned spaced apart from one another on the longitudinal axis of the batten and the brackets 16 are guidedly movably connected with the substructure 13 by guide members 14 individually corresponding to the brackets. The guide members 14 are securely fixed in place by means of screws 15 or by any other suitable fastening means to maintain alignment of the brackets, and are provided each with a pair of parallel under cut grooves 18 leading from end to end of the guide member longitudinally of the batten 11.

Brackets 16 are inverted generally U-shaped members having a pair of legs 19 (see FIG. 2) interconnected by a bridger member 20, with the legs 19 of each of the brackets having guide follower portions 19*c* at their outer ends. The guide follower portions 19*c* of the bracket legs conform within close tolerances to the under cut grooves 18 of the related guide member 14 and are engaged in those grooves for following the grooves slidably longitudinally of the batten 11. Also, in accordance with the present embodiment, inner portions 19*a* of the legs 19 in each of the brackets 16 converge with reference to one another leading away from the bridger member 20 and merge with outer generally parallel portions 16*b* of the bracket legs, having the latter portions terminate at the guide follower portions 19*c* of the bracket legs. The guide members 14 and brackets 16 are for example cut from extrusions made of any suitable material such as an aluminum base alloy of any satisfactory grade. For purposes hereinafter to be described, the bridger member 20, of each of the brackets 16, is outwardly configurated to present twin parallel channels 20*a* joined with the adjacent ends of the bracket legs 19 and interconnected by a raised intermediate rib 20*b*, all leading longitudinally of the related batten 11 in the system.

Each of the battens 11 in accordance with the present embodiment is inclusive of a gutter 23 (see FIG. 3) longitudinally leading throughout the length of the batten 11 and the gutter is made for example of sheet galvanized steel or aluminum base alloy sheeting. The gutter 23 has a bottom wall 23*a* (see FIG. 2) interconnecting a pair of side walls 23*b*, which include portions diverging outwardly from one another in directions extending from the bottom wall 23*a* toward the laterally open side of the gutter.

Gutter 23 in the installed position, in the batten 11, is sufficiently resilient to press the divergent side walls 23*b* thereof against the convergent inner leg portions 19*a* of each of the brackets 16 in the batten, and thereby forcefully frictionally engage the gutter 23 with the brackets 16. The outer ends of the gutter side walls 23*b*, adjacent to the laterally open side of the gutter, accordingly enter a pair of grooves 24 formed inside the brackets 16 by the bridger member 20 and the legs 19 of the bracket. The gutter 23 thus, as installed, is supported in the bracket solely by the legs 19 of the bracket.

Preferably, the lateral dimension of the gutter bottom wall 23*a* is appreciably less than the width of the gap between the guide follower portions 19*c* of the legs in each of the brackets 16, and the gutter 23 is sufficiently resilient to allow the gutter side walls 23*b* to be sprung toward each other, thus for the brackets 16 to be applied laterally of the gutter, by receiving the gutter through the gap between the bracket legs, and thereafter cause the side walls 23*b* of the gutter to spring laterally into a position wherein the gutter side walls diverge and resiliently press forcefully in frictional contact with the bracket legs 19 in the manner already set forth above. In certain embodiments, still in accordance with the present invention, the brackets may instead be formed to accept the gutter 23 only endwise of the gutter and thereafter be moved into position longitudinally along the gutter.

With reference to each of the battens 11, an adjacent pair of lateral extensions 12*a* rise integrally from flat panel wall structure 12*b* in a pair of panel members 12 on opposite sides of the batten and longitudinally coextend with the panel wall structure 12*b* while producing opposite side walls of the batten. Between the batten side walls 12*a*, the aligned brackets 16 along with their related guide members 14 and the gutter 23 of the batten of course are present. Further, in each of the battens 11, the side walls 12*a* thereof have angular end portions 12*c* adjacent to the junctions of the legs 19 with the bridger members 20 in the brackets 16 and these angular end portions form ends projecting from outside the brackets 16 in the batten into the pairs of channels 20*a* in the bridger members of the brackets 16 in the batten, and over the open side of the gutter 23 for shedding water as need may be into the gutter.

The panel wall structures 12*b* of the panel members 12 are also each provided at lower longitudnal end with a reverse bend (see FIG. 4) forming an underside hook 12*d* extending transversely of the panel 12 and with a top side hook 12*f* at the longitudinal upper end extending transversely of the panel 12. The lower and upper hooks 12*d* and 12*f* are respectively engaged with lower and upper hooks 25 and 26 formed by strips, which lead transversely of the lower and upper ends of the panel member 12 and are secured to the substructure 13 to connect the panel member 12 with the substructure. In this latter regard, it will be understood that the upper connection produced by the hooks 12*f* and 26 constitutes an expansion joint affording an appreciable tolerance for the panel member 12 bodily to expand and contract substantially freely longitudinally.

The panel members 12 preferably are made from sheeting, such as of aluminum base alloy or galvanized steel, though of course any other suitable material or materials may instead be used.

Where the flat wall structures 12*b* in the panel members 12 occur between battens 11, as described, both lateral ends of the panel 12 are formed to include raised extensions 12*a* for these extensions to produce sides in the corresponding battens 11, and for positions in the panel system 10, laterally outward from the last battens 11 in the system, any suitable terminal member 45 (see FIG. 1) may be used for covering the related area of the substructure 13 and need have but one raised extension thus to contribute a side wall of a batten.

A batten cover 28 in each of the battens 11 in the present embodiment is characterized by including a cover web 28*a* which longitudinally and laterally extends externally adjacent to the angular end portions 12*c* of the batten side walls 12, and also covers the gutter 23 and the brackets 16 along with the guide members 14 in the batten, while resting upon the bridger member ribs 20*b* of the brackets 16 in the batten. Further, the batten cover 28 has a pair of flanges 28*b* which are interconnected by the web 28*a* and the flanges 28*b* depend downwardly externally adjacent to the batten side walls 12*a* produced by the related panel members 12. In the foregoing position, the batten cover 28 is secured to the brackets 16 in the batten through use of screws 22 passing through apertures in the web 28*a* and threadedly engaging the bridger members 20 of the brackets 16 in the batten. The screws 22 advantageously carry sealing washers 29 under their heads and against the outside face of the batten cover web 28*a*. Batten cover 28 is for example made of aluminum base alloy or galvanized steel sheeting or instead may be an extrusion produced from any suitable material.

It will therefore be appreciated that the batten cover 28 is carried by the brackets 16 which in turn are guidedly movably engaged with the substructure 13 to move in response to longitudinal thermal expansion and contraction bodily of the batten cover member 28 and support the gutter 23. Each gutter 23, panel member 12 and batten cover 28 may of course need not necessarily be comprised of a single longitudinal section, but instead may, if desired, be in several sections longitudinally progressively, with each of the sections being installed to tolerate longitudinal contraction and expansion in keeping with the present objectives.

Figure 1:
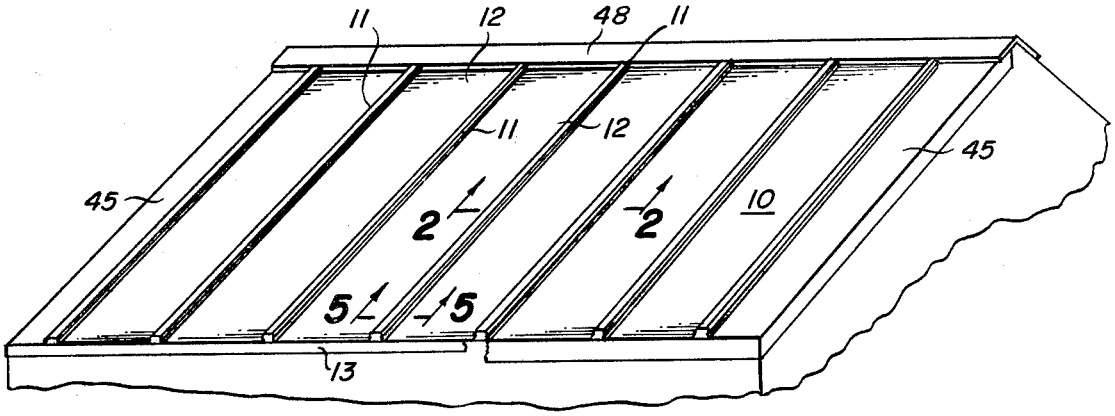
FIG. 1 is an isometric view of a panel and batten system.
Figure 2:
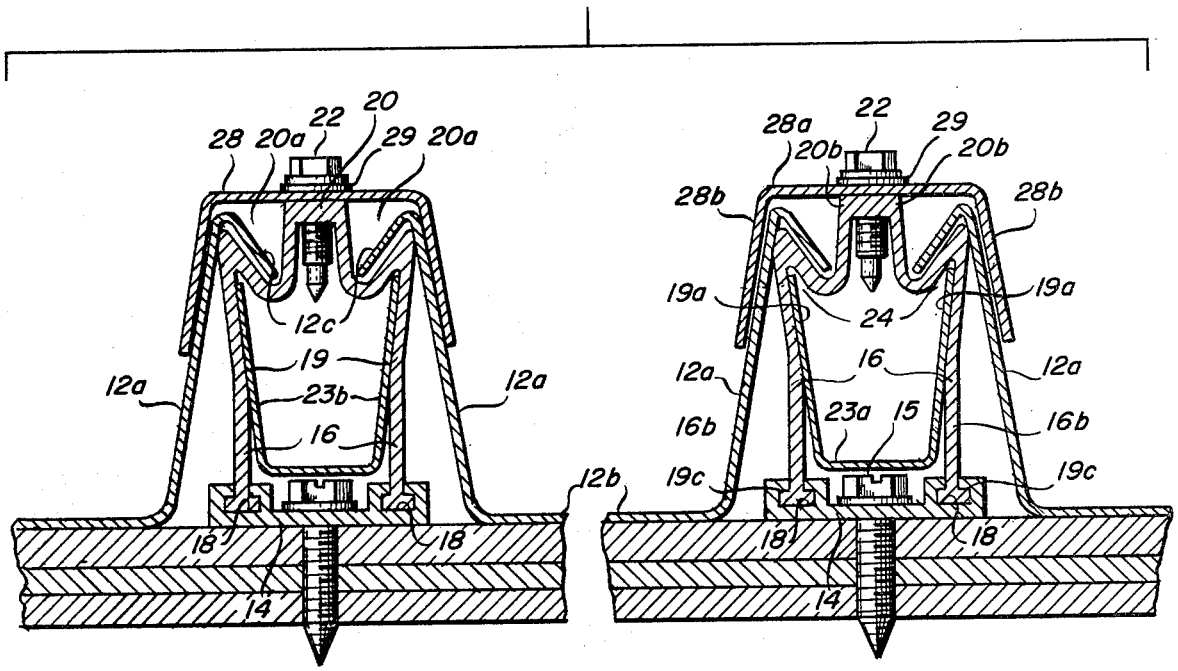
FIG. 2 is a cross sectional detail view of the batten and panel system taken at 2—2 in FIG. 1.
Figure 5:
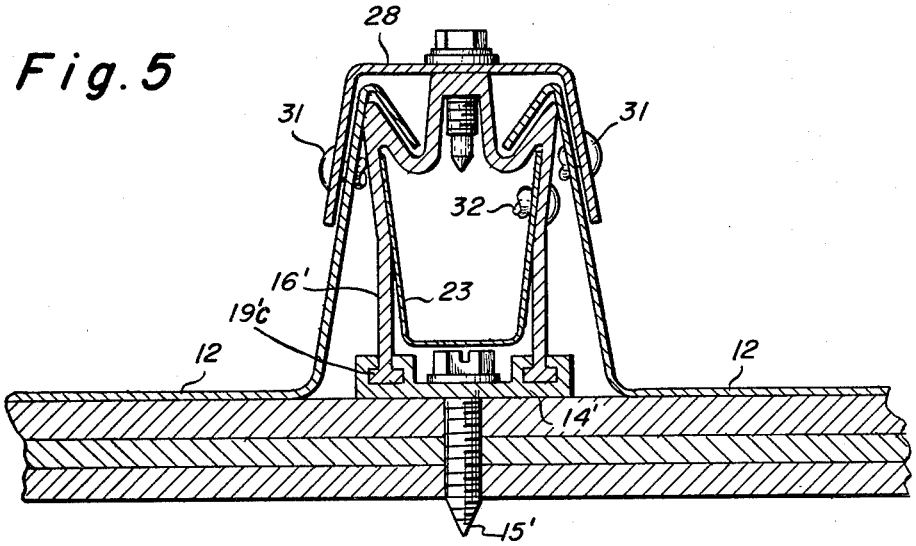
FIG. 5 is a cross sectional view taken on line 5—5 in FIG. 1 and includes a representation of a lowermost bracket in the batten.

The guide follower portions 19*c* of the brackets are adapted to permit appreciable longitudinal movement thereof along the under cut grooves 18 in the guide members 14 in response to thermal changes encountered by the batten cover 28 which is substantially free to expand and contract bodily longitudinally. In this regard, it becomes advantageous particularly in certain installations in accordance with the present invention to have a portion of the batten cover 28 longitudinally anchored with the remainder of the batten being substantially free to move longitudinally and to exemplify such practices it is noted here that a lowermost bracket 16' similar to the brackets 16 in the bracket alignment in the batten (see FIG. 3) has its guide follower portions 19*c'* blocked against effecting any substantial amount of longitudinal movement in the under cut grooves 18' of a related guide member 14' in each of opposite longitudinal directions such as by peening at 36' and 37' the under cut groove or grooves 18' closed closely against the opposite longitudinal ends of the guide follower member or members 19*c'* to entrap those ends against longitudinal movement in each of opposite longitudinal directions. Guide member 14' is aligned with the guide members 14 in the batten 11 and is spaced longitudinally in the batten from an adjacent one of the guide members 14 and is securely fixed in place by a screw 15' to the substructure 13 thus to maintain the bracket 16' in a substantially fixed position. For all of the brackets 16 and their guide members 14 associated with the batten 11 above the lowermost bracket 16', the groove or grooves 18 in the guide members 14 corresponding to those brackets are peened shut or are otherwise blocked off at their opposite longitudinal ends 36 and 37 to prevent escape of the corresponding guide follower portions 19*c* therefrom and yet to allow longitudinal movement of the follower positions 19*c* therein within desired limits, thereby enabling the batten cover 28 longitudinally to expand and contract substantially freely bodily with reference to the lower most bracket 16' in the batten. A roof ridge cap 48 represented in FIG. 1 conceals the uppermost longitudinal end portions of the batten covers 28 in the panel and batten system 10 and tolerates longitudinal movement of the batten cover members for those members bodily to expand and contract substantially freely longitudinally. The invention of course lends itself to many other possible ways for the batten cover member 28 to be anchored for substantially free longitudinal expansion and contraction of the batten cover bodily to occur. It will also be understood that each of the panel members 12 may have substantial freedom bodily to expand and contract longitudinally by use of the longitudinal expansion joints effected at 12*f* and 26 between the panel members 12 and the substructure 13. When it is desired to anchor a portion of each of the panel members 12 for the panel member to expand and contract substantially freely bodily with reference to the anchorage location, anchorage for that purpose is for example had by fixing the panel members 12 to the lower ends of the batten cover 28 by rivets 31 such as adjacent to the lowermost bracket 16' as shown in FIG. 5. In instances where it is desired to anchor the gutter 23 to effect substantially free longitudinal movement bodily, the gutter is for example riveted at 32 to the lowermost bracket 16' in the batten row as shown with the opposite longitudinal end of the gutter being longitudinally free to move.

In FIGS. 6 and 7, relating to a modified embodiment of the present invention, the panel and batten system represented is otherwise similar to that of FIGS. 1 to 5, inclusive, except for having a modified batten cover 35 in each of the battens in the system along with clips 36 for securing the batten cover to the brackets 16 and 16'. The clips 36 (see FIG. 7) are characterized by being connected through aperture therein by screws 39 to the related bridger members 20 or 20' which form components of the several brackets 16 or 16' in the batten. The clips include first and second arms 36*a* oppositely directed laterally of the batten and a resilient tongue 36*b* projecting outwardly of the related bridger member 20 or 20' of the bracket 16 or 16'. Batten cover 35 has a web 35*a* interconnecting a pair of downwardly directed flanges 35*b* having in-turned edges 35*c* for the tongues 36*b* resiliently to press against the inner face of the web 35*a* outwardly while the arms 36*a* engage the in-turned edges 35*c* of the flanges 35*b* in the batten by snap fit for holding the batten cover 35 in place in the batten. Either the arms 36*a* or the batten cover 35, or both, are resilient enabling snap action to take place in engaging the batten cover 35 with the clips 36.

As the invention lends itself to many possible embodiments and as many changes may be made in the embodiments hereinbefore set forth, it will be distinctly understood that all matter described herein is to be interpreted as illustrative and not as a limitation.

I claim:

1. In a panel and batten system, the combination which includes a plurality of brackets each comprising a pair of leg means, and bridger means interconnecting said pair of leg means; bodily substantially freely longitudinally expansible and contractable gutter means carried by said pairs of leg means of said brackets over a substructure and under said bridger means of said brackets and having a laterally open side, with said brackets being aligned spaced apart from one another on an axis; guide means connected with said substructure, said guide means and outer ends of said pairs of leg means of said brackets including interlocked, longitudinally relatively movable tongue and grooved portions underlying said gutter means, for said brackets movably to follow said guide means longitudinally of said guide means in interlock with said guide means laterally of said guide means and for said pairs of leg means of said brackets to transmit thrust from said bridger means of said brackets to said guide means and be retained assembled with said guide means longitudinally of said pairs of leg means; first and second panel means on said substructure, said first and second panel means each being bodily substantially freely longitudinally expansible and contractable and comprising panel structure and batten wall means raised outside said gutter means and said brackets and introducing an end adjacent to said laterally open side of said gutter means, having said gutter means and said brackets in positions intermediate said batten wall means of said first and second panel means; and bodily substantially freely longitudinally expansible and contractable batten cover means covering said laterally open side of said gutter means, said brackets and relatively movably said ends of said batten wall means of said first and second panel means and connected with said bridger means of said movably guided brackets to move with said brackets during longitudinal expansion and contraction of said batten cover means.

2. In a panel and batten system as set forth in claim 1 wherein each of said first and second panel means is connected with said substructure through expansion joint means and has a portion thereof anchored, for continuing portions of said first and second panel means to expand and contract substantially freely longitudinally of said batten cover means with reference to said anchored portions of said first and second panel means.

3. In a panel and batten system as set forth in claim 2 wherein an additional bracket aligned with said guidedly movable brackets and carrying said gutter means intermediately of said batten wall means of said first and second panel means is substantially fixed to said substructure, and said anchored portions of first and second panel means are anchored to said additional bracket for said continuing portions of first and second panel means each longitudinally to expand and contract substantially freely with reference to said additional bracket.

4. In a panel and batten system as set forth in claim 1 wherein each of said first and second panel means is connected with said substructure through expansion joint means and has a portion thereof anchored, for continuing portions of said first and second panel means to expand and contract longitudinally of said batten cover means and substantially freely with reference to said anchored portions of said first and second panel means, and portions of said gutter means and said batten cover means are anchored, for continuing free-ended portions of said gutter means and said batten cover means each longitudinally to expand and contract substantially freely with reference to said anchored portions thereof.

5. In a panel and batten system as set forth in claim 1 wherein said guide means includes means for stopping movement of said brackets in each of opposite directions longitudinally of said batten cover means and allowing said movement to be within permissible limits.

6. In a panel and batten system as set forth in claim 1 wherein said guide means includes a plurality of guide members spaced apart from one another longitudinally of said gutter means and secured to said substructure, and said guide members form said interlocked longitudinally relatively movable tongue and grooved means with said outer ends of said pairs of leg means of said brackets, for said brackets to be moved and guided longitudinally of said batten cover means relatively to said substructure while interlocked with said guide members laterally of said guide members and longitudinally of said pairs of leg means of said brackets.

7. In a panel and batten system as set forth in claim 6 wherein said guide members include means for blocking movement of said brackets along said guide members in each of opposite directions and limiting said movement of said bracket relatively to the guide member to be within a permissible range.

8. In a panel and batten system as set forth in claim 7 wherein each of said first and second panel means is connected with said substructure through expansion joint means and has a portion thereof anchored, for continuing portions of said first and second panel means to expand and contract substantially freely longitudinally of said batten cover means and with reference to said anchored portions of said first and second panel means, and portions of said gutter means and said batten cover means are anchored, for continuing free-ended portions of said gutter means and said batten cover means each longitudinally to expand and contract substantially freely with reference to said anchored portions thereof.

9. In a panel and batten system as set forth in claim 1 wherein said gutter means includes first and second side wall means and is resilient for resiliently springing said first and second side wall means transversely against said pairs of leg means of said brackets for engaging said gutter means frictionally longitudinally slidably with said brackets.

10. In a panel and batten system as set forth in claim 9 wherein said pairs of leg means of said brackets are spaced apart from one another in said brackets for said brackets to receive said gutter means laterally of said gutter means in effecting assembly of said brackets with said gutter means.

11. In a panel and batten system as set forth in claim 1 wherein said batten cover means is connected with said bridger means of said brackets by screws extending through said batten cover means and threaded into said bridger means of said brackets.

12. In a panel and batten system as set forth in claim 1 wherein spring means, having first and second arm means disposed outside said first and second batten wall means of said panel means and having resilient tongue means projecting outwardly from said bridger means of said brackets, are secured to said bridger means of said brackets, and said batten cover means includes first and second flange means and web means interconnecting said first and second flange means, for said tongue means resiliently to press said web means outward while said first and second arm means engage said first and second flange means for holding said batten cover means in place.

13. In a panel and batten system as set forth in claim 1 wherein portions of said pairs of leg means of said brackets converge with reference to one another, in said bracket, leading away from said bridger means of said bracket, and first and second side wall means of said gutter means diverge from one another toward said open side of said gutter means, for said divergent first and second side wall means of said gutter means laterally to rest against said convergent portions of said pairs of leg means of said brackets.

* * * * *